United States Patent [19]

Chang et al.

[11] 4,448,445

[45] May 15, 1984

[54] PRESSURE-SENSITIVE RECORD SYSTEM

[75] Inventors: John C. H. Chang, Naperville; Theodore Dimitriou, Deerfield, both of Ill.

[73] Assignee: Wallace Computer Services, Inc., Hillside, Ill.

[21] Appl. No.: 347,171

[22] Filed: Feb. 10, 1982

[51] Int. Cl.[3] ..... B41M 5/22

[52] U.S. Cl. ..... 346/206; 346/226; 346/209; 428/537.5; 428/342; 428/487

[58] Field of Search ..... 427/150–153; 428/320.8, 537, 913, 914, 341, 342, 411, 488; 282/27.5

[56] References Cited

U.S. PATENT DOCUMENTS

| | | | |
|---|---|---|---|
| 3,554,781 | 1/1971 | Matsukawa | 282/27.5 |
| 3,708,323 | 1/1973 | Strobie | 117/36.7 |
| 4,012,554 | 3/1977 | Miller et al. | 428/327 |
| 4,096,314 | 6/1978 | Cespon | 428/320.8 |
| 4,109,047 | 8/1978 | Fredrickson | 428/916 |
| 4,121,961 | 10/1978 | Brunette et al. | 282/27.5 |
| 4,137,046 | 1/1979 | Koike et al. | 428/537 |
| 4,139,218 | 2/1979 | Davis et al. | 282/27.5 |
| 4,170,483 | 10/1979 | Shackle et al. | 282/27.5 |
| 4,327,148 | 4/1982 | Toyama et al. | 428/320.8 |

*Primary Examiner*—Bruce H. Hess

*Attorney, Agent, or Firm*—Roylance, Abrams, Berdo & Goodman

[57] ABSTRACT

A pressure sensitive copy system comprising a plurality of sheets in superposed relationship in which at least one sheet comprises a semi-translucent support bearing either an autogenous layer or a color-developer layer and at least one other sheet comprises a support bearing the other of such layers. The autogenous layer comprises microcapsules and electron-acceptor material in which the microcapsules contain chromogenic material sufficient to form a visible image in the autogenous layer and in the color-developer layer.

10 Claims, 4 Drawing Figures

PRESSURE-SENSITIVE RECORD SYSTEM

FIELD OF THE INVENTION

This invention relates to a pressure-sensitive record system. More particularly, this invention relates to a pressure-sensitive record system which utilizes semi-translucent copy sheets and combines aspects of both self-contained and transfer copy paper systems to provide more economical multi-part business forms which can be utilized with a writing device without conventional ink in the ribbon to provide a visible image on the face side of the top-ply.

BACKGROUND OF THE INVENTION

Pressure-sensitive marking systems which involve localized contact between a color forming chromogenic compound, such as crystal violet lactone, benzoyl leuco methylene blue, etc. and a complementary color-developing substance, such as an acid-treated clay, to produce a color marking on paper or the like are well-known. Generally, colorless chromogenic substance is dissolved in minute oil droplets and encapsulated within the walls of pressure-rupturable microcapsules to prevent reaction between the chromogen and the color developer until the capsules are ruptured under the pressure of a writing device.

Two distinct systems have emerged, namely, the "transfer copy system" and the "self-contained" or "autogenous" system. In the transfer copy system, microcapsules containing the colorless chromogenic substance are coated in an aqueous dispersion of microcapsules onto the back of a substrate to form a "CB" (coated back) sheet which is superimposed onto the receiving sheet, which is coated with an electron-accepting color developer material, for example, of the Lewis acid type, such as acid-treated clay known as a "CF" (coated front) sheet. Upon application of localized pressure to the top side of the microcapsule-coated sheet, the walls of the microcapsules, which are on the back or underside of the CB sheet, are ruptured releasing the colorless, chromogenic substance for reaction with the acidic co-reactant on the CF sheet to provide a distinctive mark.

In the self-contained or autogenous system, the acidic co-reactant and the encapsulated chromogenic material are coated together to form an autogenous layer on the same substrate, and thus when the capsule walls are ruptured, there is no physical transfer or movement or either mark-forming component from one sheet to another. Rather, the colored mark is produced on the sheet bearing the capsules.

Typical record systems involved a multiplicity of sheets wherein, for example, the top sheet is a "CB" sheet comprising a substrate having a microcapsular coating on the underside thereof, superimposed upon a number of "CFB" (coated front and back) sheets, each of which comprise a support bearing a color-developing electron-accepting layer on the front thereof and a microcapsular coating on the underside thereof. The final or bottom sheet is normally a "CF" sheet bearing an electron-acceptor layer on the front side thereof. Thus, to form the CFB or middle sheets of the multi-ply record system, two coatings, i.e., a front and a back coating, are required for each CFB sheet. In a six-part form set, for example, ten separate coatings would be required. In view of the high energy costs involved in high temperature drying water-based coatings, it would be highly desirable to reduce the number of coatings required in the production of such multi-ply form sets.

SUMMARY OF THE INVENTION

A pressure-sensitive record system combining features of self-contained and transfer systems has been discovered which can be produced using fewer coatings than are required for a transfer copy record system, yet providing the same number of copy sheets. The pressure-sensitive record system of the present invention comprises a plurality of sheets in superposed relationship wherein at least one of the sheets comprises a semi-translucent support bearing an autogenous layer comprising microscopic pressure rupturable capsules and an electron-accepting material, and a like number of other sheets comprises a support bearing a color-developer layer comprising an electron-acceptor material. The sheets of the present record system are disposed such that the autogenous layer and the color-developer layer are in direct, superimposed contact so as to enable transfer of excess chromogen from the ruptured microcapsules to the color developer layer. The capsules contain chromogenic material in amounts sufficient to form a visible marking upon contact with the elctron-acceptor material in both the autogenous layer and the color-developer layer. At least one of the supports is semi-translucent so that a visible marking formed on one side of such support is visible from the other side.

According to one embodiment of the present invention, a copy sheet is formed from a semi-translucent support bearing an autogenous layer on the underside thereof, and such copy sheet is superimposed over a second copy sheet comprising a support bearing a color-developer layer on the front side thereof.

According to a further embodiment of the present invention a copy sheet is formed from a semi-translucent support bearing a color-developer layer on the underside thereof and is used in a superposed relationship with a second sheet comprising a support having the autogenous layer on the front side thereof.

In all embodiments of the present invention, sufficient chromogenic material is utilized both to provide a visible marking in the autogenous layer, and, additionally, an amount sufficient to be transferred to the color-developer layer to concomitantly form a visible marking thereon. When the copy sheets are separated, the visible marking on the back side of the semi-translucent sheet is visible from the front side thereof, while the marking formed by transfer of the chromogen to the underlying copy sheet can be directly viewed from the front side thereof.

Thus, the record systems of the present invention possess aspects of both self-contained systems and transfer copy systems, but has the distinct advantage that fewer coatings are required to form a multi-ply business form than are required to manufacture such forms using a transfer copy system. Additionally, a visible image can be formed on the top ply of the multi-ply business forms of the present invention solely by pressure, and without the need for inked ribbons, ballpoint pen ink, pencils, fountain pens or other writing devices, since the semi-translucent substrate of the top ply permits the image on its underside to be viewed from the front side of the sheet.

DESCRIPTION OF THE PREFERRED EMBODIMENTS

Figure 1:
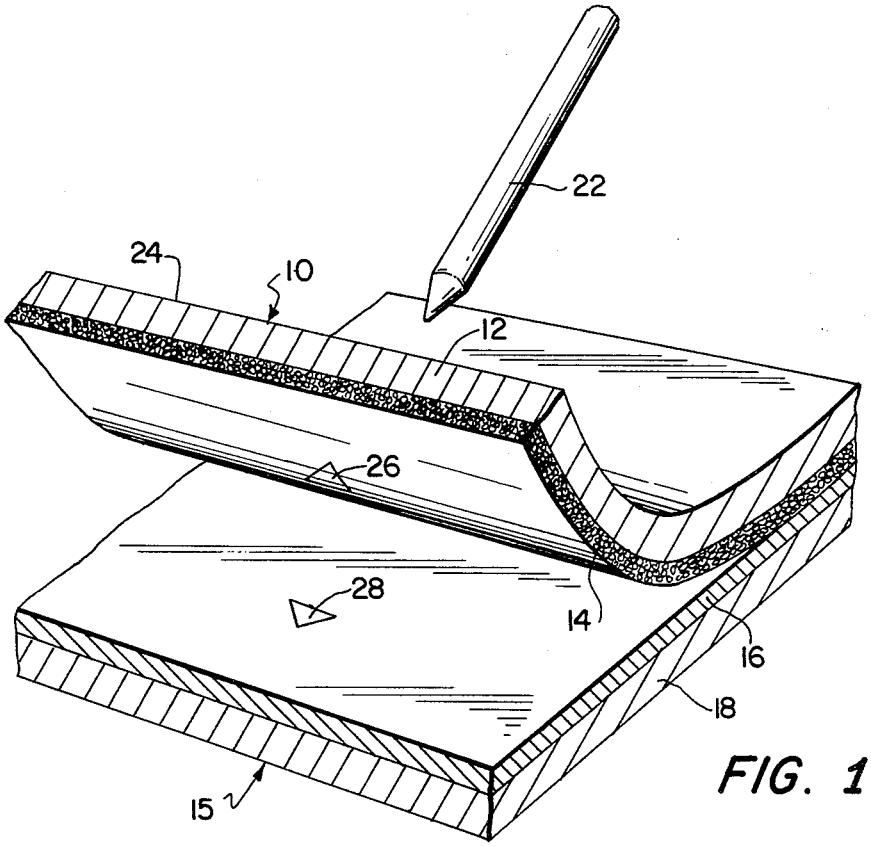
FIGS. 1 and 2 depict a perspective view essentially schematic of a two-ply business form according to the present invention.

Referring to FIG. 1, a copy system is shown wherein sheet 10 comprises a support web 12 coated on its back or underside with an autogenous layer 14 comprising a combination of pressure-rupturable microcapsules and electron-acceptor material. Top sheet 10 is superposed over sheet 15 comprising color-developer layer 16 adhered to substrate 18.

Support web 12 is semi-translucent and comprises, for example, a paper web that has been treated with a translucentizing agent, such as an oily solution of a natural wax, which can be, for example, paraffin wax, microcrystalline waxes, mineral waxes, vegetable waxes, etc., as well as synthetic waxes, including hydrocarbon waxes, e.g., linear polyethylene waxes, fatty acid esters, etc. Solutions of such waxes in natural oils, such as mineral oil, vegetable oil, cotton seed oil, coconut oil, etc., or synthetic oils, such as non-aromatic hydrocarbon oil, synthetic esters, or the like, may be utilized to form the waxy solution that is applied to the paper web. The translucentizing agent can have printing ink-like consistency for easy application to the paper web on a printing press, either over the entire or selected areas of the web.

The term "semi-translucent" as used herein in connection with the support, means that the support, e.g., a paper web, is sufficiently translucent that colored markings on the underside of the web can be viewed with the naked eye through the web from the top side of the web. The translucentizing agent may be applied at any desired concentration to obtain the desired degree of translucency in the paper web. For example, the translucentizing agent may be applied to a paper web at a weight of from about 0.1 to about 1 pound per 1,300 square feet of area, preferably from about 0.1 to about 0.5 pound per 1,300 square feet. The preferred basis weight of a web is about 10 to about 20 pounds per 1,300 square feet.

Although the preferred semi-translucent support web is ordinary paper, the suitable semi-translucent supports may be formed from materials including polyethylene fibers, highly aromatic polyamide synthetic fibers, polyester fibers and other synthetic pulps.

Autogenous layer 14 may be formed using any formulation utilizable in the production of self-contained copy sheets to provide an autogenous layer comprising both pressure-rupturable microcapsules, which contain chromogenic material (color-precursors) and electron-acceptor (color-developer) material. For example, suitable formulations are described in U.S. Pat. Nos. 3,906,123; 3,663,256; 3,732,120; 3,554,781; 3,576,660; and 4,170,483, the disclosures of which are hereby incorporated by reference.

The autogenous coating comprises microcapsules having walls formed from coacervated gelatin, polycondensates from interfacial cross-linking, and hydrolyzed isocyanatoamidine product. The preferred microencapsulation process is described in U.S. patent application Ser. No. 100,638 to J. C. Chang filed Dec. 5, 1979, the disclosure of which is hereby incorporated by reference. Preferred electron-acceptor materials for inclusion in the autogenous layer are the Lewis acids conventionally used to prepare carbonless copy papers. Preferred Lewis acids include, for example, alkylphenol-formaldehyde novolac resins, zinc salts of alkylsalicylic acids, acid activated clays, and the like.

As indicated previously, the microcapsules contain an oily solution of a chromogen. Suitable chromogens include, for example, crystal violet lactone, benzoyl leuco methylene blue, fluorans, phthalides, rhodamine $\beta$ lactams, and the like. Suitable chromogens are disclosed, for example, in U.S. Pat. Nos. 3,954,803 and 4,012,419 to D. N. Vincent and C. H. Chang, which are hereby incorporated by reference.

The microcapsules may be of any suitable size, for example, and have an average diameter of between about 1 to about 20 microns, preferably, between about 3 to about 7 microns. It is a vital feature of the present invention that the chromogen be provided in the autogenous layer in amounts sufficient to form not only a visible marking in the autogenous layer, but also to transfer to the underlying color-developing layer and form a visible marking in such layer as well. Thus, the amount of chromogen used is at least 50 percent in excess of the amount needed to react with the Lewis acid in the autogenous layer, and may be present in amounts of from about 2 parts by weight to about 20 parts by weight chromogen, preferably, from about 5 parts by weight to about 10 parts by weight chromogen per 100 parts by weight electron acceptor in the autogenous layer.

Preferably, the autogenous layer additionally contains a color suppressant to prevent premature coloration during the coating process. The color suppressant must be so chosen that it will not inhibit or adversely affect the color formation in the final product. Preferred color suppressants include, for example, ammonium hydroxide, condensates of amine-formaldehyde, such as urea-formaldehyde, melamine-formaldehyde, and the like. Suitable amounts of such color suppressants include from about 0.1 to about 10, preferably from about 0.5 to about 4 percent by weight based on the total dry weight of the coating composition. Other suitable color suppressants are disclosed, for example, in U.S. Pat. Nos. 4,010,292 and 4,170,483, which are hereby incorporated by reference.

Autogenous layer 14 is superposed over a color-developing layer 16 which is on support web 18. Layers 16 and 18 form a CF sheet 15 depicted in FIG. 1. Color-developer layer 16 comprises any suitable electron-acceptor material as previously described with respect to layer 14, and thus layer 16 can comprise a conventional acid-activated clay. Support 18 can comprise any conventional substrate normally utilized in copy systems and may be the same web material as support 12, but it need not be made semi-translucent.

When writing instrument 22 applies imprinting pressure, such as that used for credit card sales slips, or by a stylus to the top surface 24 of support web 12, the microcapsules in autogenous layer 14 which lie directly under the point of instrument 22 rupture releasing chromogen some of which reacts with the Lewis acid in layer 14 to form a visible image 26 and the excess chromogen transfers to layer 16 and reacts with Lewis acid in layer 16 to form a visible image 28 in layer 16. The marking 26 is viewable through semi-translucent support web 12.

A significant advantage of the present invention is that stylus 22 need not be a writing instrument such as a ballpoint pen which, itself, transfers its ink to the front surface 24 of web 12, but need only have a point or edge sufficient to apply local pressure to surface 24 and rupture the microcapsules present in autogenous layer 14 and release chromogen therein, since the mark formed in layer 14 is viewable through support 12 from its front side.

Figure 2:
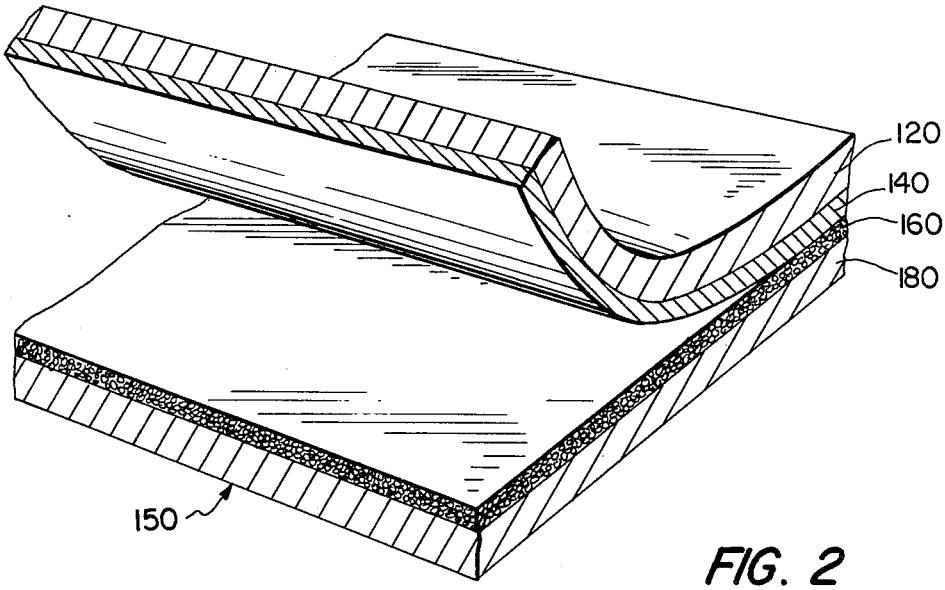

The copy system shown in FIG. 2 is similar to that shown in FIG. 1, except that the autogenous and developer layers in the two sheets are reversed in position with autogenous layer 160 coated on substrate 180 to form bottom sheet 150. According to this embodiment of the present invention, support web 120, which bears color-developer layer 140 is semi-translucent, while support layer 180 which bears autogenous layer 160 need not be semi-translucent.

Figure 3:
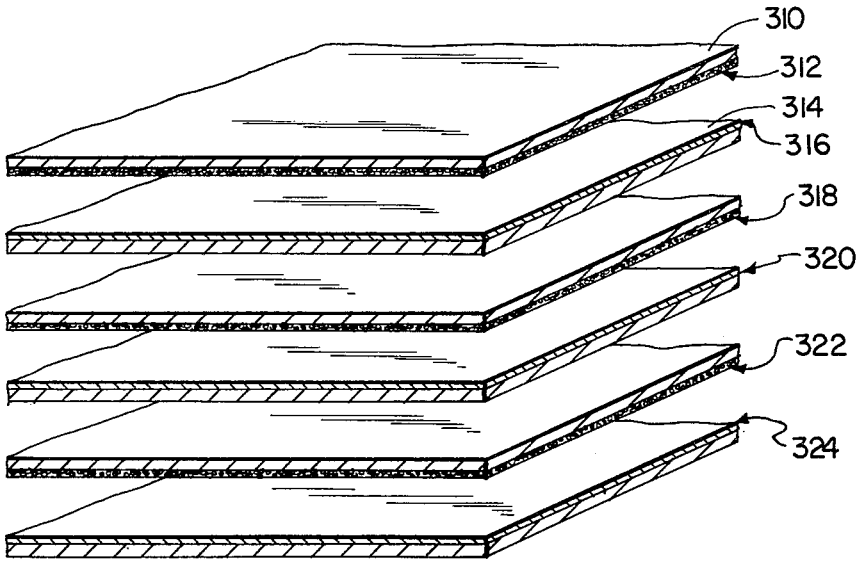
FIG. 3 is a perspective, substantially schematic representation of a multi-ply form in accordance with the present invention.

FIG. 3 shows a multi-ply record system in accordance with the present invention wherein the middle sheets only have a single coating on each sheet rather than the usual front and back coatings required for CFB sheets using the transfer copy systems. Thus, top sheet 310 is provided with autogenous layer 312 on its underside, and is superimposed over sheet 314 having color-developer layer 316 coated on the top surface of sheet 314. This sequence of repeated for sheets 318, 320, 322 and 324.

Figure 4:
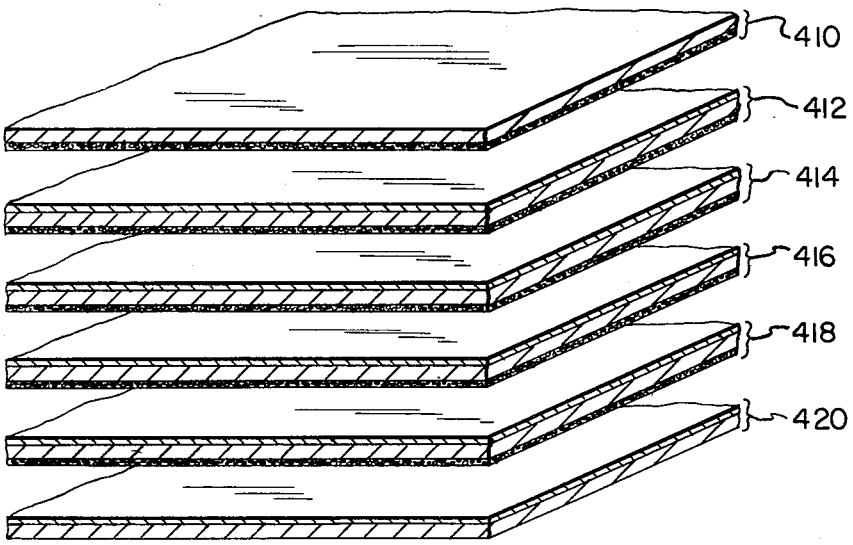
PRIOR ART FIG. 4
FIG. 4 is a perspective, substantially schematic multi-ply form utilizing the transfer copy system of the prior art.

By contrast, the conventional transfer copy system is shown in the six-part form in FIG. 4 wherein only top sheet 410 and bottom sheet 420 are provided with a single coating. Intermediate copy sheets 412, 414, 416 and 418 are the conventional "CFB" sheets which are coated on the front side thereof with a color-developer layer and on the back side or underside thereof with a layer containing encapsulated chromogen. Thus, whereas the six-part form of the present invention shown in FIG. 3 requires only six coatings, the conventional six-part form set of FIG. 4 requires ten separate coatings. In view of the high energy costs involved in dry water-based coatings, the elimination of four coatings represents a significant energy savings in connection with the high-temperature drying required for the additional coatings.

The copy systems of the present invention have numerous applications including those applications to which copy papers have normally been utilized. However, the record system of the present invention has a particular advantage in the production of multi-part forms used for credit card sales slips. For example, the record system of the present invention eliminates the need for using double-faced carbon papers which have to be removed manually and using an autogenous coating on the face side of the top-ply.

The invention will be further illustrated by the following examples. The percentages are by weight unless otherwise specified.

EXAMPLE I

Fifty grams of capsule slurry containing 0.32 gram of crystal violet lactone chromogen and 2.67 grams of polyvinylalcohol were made basic with 30 grams of ammonium hydroxide. Thirty grams of melamine formaldehyde condensate were mixed into the resulting slurry. Fifteen grams of starch (commercially available as Keestar 327 from Henkel Corporation) were added, followed by the addition of 20 grams of a phenolic novolac resin dispersion at 57% solids. The resulting mixture was coated on a semi-translucent paper (10-lb. basis weight per 1,300 sq. ft.) at a coat weight of about 2 pounds per 1,300 square feet of area.

The resulting coated paper was used to produce a form set with an acid activated clay CF paper by arranging both coated sides to face each other. When the form set was used as a business form, for example, a credit card sales slip, the imprinting pressure, which was applied either from the top or bottom side of the form set, developed blue images on the face of the second ply and the back of the first ply. Due to the translucency of the top ply paper, images were also easily seen from the face side of first ply.

EXAMPLE II

To 50 grams of capsule slurry containing 0.1 gram of 3'-methyl-2'-(phenylamino)-6'-(1-pyrrolidinyl)-spiro[isobenzofuran-1(3H),9'-(9H)xanthene]-3-one, 0.2 grams of 6'-(cyclohexyl methyl amino)-3'-methyl-2'-(phenylamino)-spiro[isobenzofluoran-1-(3H),9'-(9H)xanthene]-3-one, and 2.67 grams of polyvinylalcohol, were added the following materials in sequence: 30 grams of ammonium hydroxide, 30 grams of melamine formaldehyde condensate, 15 grams of starch (Keestar 327), and 5 grams of phenolic novolac resin diepersion at 57% solids.

In a separate formulation, a paste of 4 percent of a linear polyethylene wax (commercially available from Petrolite Corporation as Polywax 500) dissolved in a mineral oil was applied on the face side of a 10 pound per 1,300 square feet of paper surface by means of a roll coater at about 0.3 pound per 1,300 square feet. The paper became semi-translucent.

The back side of this paper was then coated with the resulting capsule slurry at about 2 pounds per 1,300 square feet. The paper was used to make a form set with a paper to which had been applied an ink-based phenolic novolac resin in selective areas. By having both coated sides to face each other in the form set, an imprinting pressure or a stylus produced images on the face side of second ply within selective areas and the back side of first ply. Images also showed through to the face side of top ply.

EXAMPLE III

Three hundred grams of a capsule slurry containing 3.2 grams of crystal violet lactone, 0.84 grams of Copiken XX (a red color former from Hilton-Davis), and 26.3 grams of gelatin was added to a solution of 100 grams of urea-formaldehyde condensate in 300 grams of ammonium hydroxide. One hundred fifty grams of starch (Keestar 327) and 200 grams of a phenolic novolac resin dispersion at 57% solids were added to the slurry. This resulting material was then coated in the selective areas on a semi-translucent paper as prepared in Example II.

When the paper was mated with an acid clay CF paper to make a form set as described in Example I, dark blue images developed within the coated areas. Images were clearly shown on the face sides of both plies.

What is claimed is:

1. A pressure-sensitive record system comprising a plurality of sheets in superposed relationship, wherein at least one of said sheets comprises a support bearing an autogenous layer comprising microscopic pressure-rupturable capsules and an electron-acceptor material;

at least one other of said sheets comprises a support bearing a color-developer layer comprising electron-acceptor material;

said autogenous layer and said color-developer layer being in direct, superimposed contact;

at least one of said supports being a semi-translucent support;

said capsules containing chromogenic material in amount sufficient to form a visible colored marking in said autogenous layer and to transfer to said color-developing layer to form a visible colored marking therein;

said semi-translucent support being sufficiently translucent that the colored marking formed on one side of said semi-translucent support is visible from the other side of said semi-translucent support with the naked eye.

2. The record system of claim 1 wherein the support bearing the autogenous layer is said semi-translucent support.

3. The record system of claim 1 wherein the support bearing the color-developer layer is said semi-translucent support.

4. The record system of claim 1 wherein the amount of chromogenic material in said microcapsules is from about 2 parts by weight to about 20 parts by weight per 100 parts by weight of the electron-acceptor material in the autogenous layer.

5. The record system of claim 1 wherein said semi-translucent support was prepared by treating a paper web with a translucentizing agent at a weight of from about 0.1 to about 1.0 pound per 1,300 square feet.

6. The record system of claim 5 wherein said translucentizing agent is applied to a paper web at a weight of from about 0.1 to about 0.5 pound per 1,300 square feet.

7. The record system of claim 1 wherein said autogenous layer contains a color suppressant.

8. The record system of claim 1 wherein selected areas of the semi-translucent support have been treated with a translucentizing agent.

9. The record system of claim 1 wherein the entire semi-translucent support has been treated with a translucentizing agent.

10. The record system of claim 1 wherein said color developer layer is coated in selected areas of said support bearing said color developer layer.

* * * * *